US011447292B2

(12) United States Patent
Bao et al.

(10) Patent No.: US 11,447,292 B2
(45) Date of Patent: Sep. 20, 2022

(54) PALLET AND PACKAGING DEVICE

(71) Applicant: HKC CORPORATION LIMITED, Shenzhen (CN)

(72) Inventors: Wenqiang Bao, Chongqing (CN); Qiong Wu, Chongqing (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/287,108

(22) PCT Filed: Dec. 13, 2018

(86) PCT No.: PCT/CN2018/120779

§ 371 (c)(1),
(2) Date: Apr. 20, 2021

(87) PCT Pub. No.: WO2020/113645

PCT Pub. Date: Jun. 11, 2020

(65) Prior Publication Data

US 2021/0354877 A1 Nov. 18, 2021

(30) Foreign Application Priority Data

Dec. 5, 2018 (CN) ..... 201822035066.0

(51) Int. Cl.
*B65D 19/44* (2006.01)

(52) U.S. Cl.
CPC ..... *B65D 19/44* (2013.01); *B65D 2519/0082* (2013.01); *B65D 2519/00761* (2013.01)

(58) Field of Classification Search
CPC ..... B65D 19/44; B65D 2519/00761; B65D 2519/00746; B65D 2519/0081; B65D 2519/00815; B65D 2519/0082
USPC ..... 108/54.1, 51.11
See application file for complete search history.

(56) References Cited

U.S. PATENT DOCUMENTS 622,666 A * 4/1899 Burwell ..... E04G 1/152 211/153
2,643,081 A * 6/1953 Spring ..... B65D 19/0093 248/167
3,176,632 A * 4/1965 Yingling ..... B65D 19/42 108/56.1

(Continued)

FOREIGN PATENT DOCUMENTS

CN 204473596 U 7/2015
CN 206243686 U 6/2017
TW I636924 B 10/2018

OTHER PUBLICATIONS

Juan Zhang, the ISA written comments, Apr. 2019, CN.

*Primary Examiner* — Jose V Chen

(57) ABSTRACT

This application discloses a pallet and a packaging device. The pallet includes: a plate body configured to support stacked cargoes; and a positioning structure connected to the plate body, where the plate body includes a bottom plate, a top plate, a plurality of foot piers, and a plurality of through holes, the bottom plate is located at the bottom of the plate body, the top plate is located at the top of the bottom plate, the bottom plate is arranged parallel to the top plate, the top plate and the bottom plate are fixedly connected through the plurality of foot piers, the plurality of through holes are located between the bottom plate and the top plate, and the positioning structure is arranged in the through hole.

16 Claims, 5 Drawing Sheets

(56) References Cited

U.S. PATENT DOCUMENTS

| | | | | |
|---|---|---|---|---|
| 3,267,884 | A * | 8/1966 | Lessheim | B65D 19/0069 108/56.1 |
| 3,888,368 | A * | 6/1975 | Hawkins | B66C 23/44 108/54.1 |
| 5,870,958 | A * | 2/1999 | Suzuki | B65D 19/0069 108/51.11 |
| 6,748,875 | B2 * | 6/2004 | Duley | F16M 5/00 108/54.1 |
| 9,422,083 | B1 * | 8/2016 | Embleton | H05K 7/186 |
| 10,173,807 | B1 * | 1/2019 | Liang | B65D 19/0095 |
| 10,343,816 | B2 * | 7/2019 | Liu | B65D 19/38 |
| 10,564,449 | B1 * | 2/2020 | Bao | F16M 11/00 |
| 10,800,599 | B1 * | 10/2020 | Moshe | B65D 85/30 |
| 2016/0325881 | A1 | 11/2016 | Embleton et al. | |
| 2017/0341853 | A1 * | 11/2017 | Koo | B65G 57/02 |

* cited by examiner

PALLET AND PACKAGING DEVICE

CROSS REFERENCE OF RELATED APPLICATIONS

This application claims priority to Chinese Patent Application No. CN201822035066.0, filed with the China National Intellectual Property Administration on Dec. 5, 2018 and entitled "PALLET AND PACKAGING DEVICE", which is incorporated herein by reference in its entirety.

TECHNICAL FIELD

This application relates to the field of display technologies, and in particular, to a pallet and a packaging device.

BACKGROUND

The statements herein only provide background information related to this application, and do not necessarily constitute the prior art.

Displays that adopt an active switch control include a liquid crystal display, an organic light-emitting diode (OLED) display, and the like. The liquid crystal display is widely used due to many advantages such as a thin body, power saving, and no radiation. A working principle of a liquid crystal panel is to place liquid crystal molecules between two parallel glass substrates, and apply a driving voltage on the two glass substrates to control a rotation direction of the liquid crystal molecules, to refract a light from a backlight to produce a picture. The OLED display can implement flexible display and large-area full-color display due to many advantages such as self-luminescence, a short response time, and high definition and contrast. Superior performance and huge market potential of the OLED display have attracted many manufacturers and scientific research institutions around the world to invest in the production and research and development of an OLED display panel.

In order to facilitate transportation of large quantities of cargoes, products are packed and stacked, and then put into a container by using a forklift. When the cargoes are placed in the container, there is a specified gap. During the transportation of the cargoes, bumpy roads, collisions of goods, and shifting of the center cause bumps to the cargoes.

SUMMARY

This application provides a pallet and a packaging device to prevent cargoes from colliding with each other.

In order to achieve the above objective, this application provides a pallet, including: a plate body configured to support stacked cargoes; and a positioning structure configured to reduce a gap between adjacent plate bodies, where the plate body includes a bottom plate, a top plate, a plurality of foot piers, and a plurality of through holes, the bottom plate is located at the bottom of the plate body, the top plate is located at the top of the bottom plate, the bottom plate is arranged parallel to the top plate, the top plate and the bottom plate are fixedly connected through the plurality of foot piers, the plurality of through holes are located between the bottom plate and the top plate, one end of the positioning structure is arranged in the through hole the other end of the positioning structure extends to outside of the through hole, and the other end of the positioning structure extends out of an edge of the bottom plate.

Optionally, one end of the positioning structure is rotatably connected to plate body, and the other end of the positioning structure is configured to rotate into the through hole.

Optionally, the positioning structure includes an insert and a latch, the latch is arranged in the through hole, one end of the insert is fixed through the latch, and the other end of the insert is configured to rotate into the through hole; the insert comprises a first convex strip, a second convex strip, and a first through hole, and the bottom plate comprises a first groove, the first convex strip and the second convex strip are cuboids, the first convex strip and the second convex strip are fixedly connected to each other perpendicularly, the first through hole is cylindrical and located on the first convex strip, the first through hole is located at an end of the first convex strip away from the second convex strip, the first groove is located at an edge of the bottom plate, and the first through hole is detachably connected to the first groove through the latch.

Optionally, a material of the latch is metal.

Optionally, a shape of each of the first groove and the latch is a cylinder.

Optionally, a diameter of the first through hole is greater than a diameter of each of the first groove and the latch.

Optionally, a diameter of the first groove is equal to a diameter of the latch.

Optionally, a diameter of the first groove is less than a diameter of the latch.

Optionally, the latch includes a first latch and a second latch, the first latch is perpendicularly connected to the second latch, and the first latch is movably connected to the first groove.

Optionally, the insert includes a reinforcing structure, a shape of the reinforcing structure is an elongated body, one end of the reinforcing structure is fixedly connected to a side wall of the first convex strip, and the other end of the reinforcing structure is fixedly connected to a side wall of the second convex strip.

Optionally, the positioning structure includes a nail, the insert includes a first convex strip, a second convex strip, and a first through hole, the bottom plate includes a first groove, the first convex strip and the second convex strip are cuboids, the first convex strip and the second convex strip are fixedly connected to each other perpendicularly, the first through hole is cylindrical and located on the first convex strip, the first through hole is located at an end of the first convex strip away from the second convex strip, the first groove is located at an edge of the bottom plate, and the first through hole is movably connected to the first groove through the nail.

Optionally, a shape of the plate body is a cuboid, there are two inserts, the two inserts are both arranged on a same side of the plate body and are symmetrical along an axis, and the axis is a central axis of a side of the plate body.

Optionally, a length of the second convex strip is greater than a spacing between a bottom surface of the top plate and a top surface of the bottom plate.

Optionally, a shape of the plate body is a cuboid, the pallet includes a second groove, the second groove is located at an edge of a long side of the plate body, the second convex strip is located at an end of the insert away from the plate body, one surface of the second convex strip is parallel to a side surface of the long side of the plate body, a distance between the second groove and the first groove is equal to a length of the first convex strip, the first convex strip rotates around the latch, and the second groove is fitted with the second convex strip when the insert is accommodated.

Optionally, the second groove penetrates the plate body, and a length of the second convex strip is equal to a thickness of the plate body.

Optionally, a depth of the second groove is equal to a width of the second convex strip, and the second convex strip is fully embedded in the second groove.

Optionally, a width of the second groove is greater than a height of the second convex strip.

Optionally, the second groove penetrates the top plate and the bottom plate, and a length of the second convex strip is equal to a thickness of the plate body.

This application further discloses a pallet, including: a plate body configured to support stacked cargoes; and a positioning structure configured to reduce a gap between adjacent plate bodies, where the plate body includes a bottom plate, a top plate, a plurality of foot piers, and a plurality of through holes, the bottom plate is located at the bottom of the plate body, the top plate is located at the top of the bottom plate, the bottom plate is arranged parallel to the top plate, the top plate and the bottom plate are fixedly connected through the plurality of foot piers, the plurality of through holes are located between the bottom plate and the top plate, one end of the positioning structure is arranged in the through hole; the positioning structure extends to outside of the through hole, and the other end of the positioning structure extends out of an edge of the bottom plate; the positioning structure includes an insert and a latch, the insert is movably connected to the through hole; the insert includes a first convex strip, a second convex strip, and a first through hole, the bottom plate includes a first groove, the first convex strip and the second convex strip are cuboids, the first convex strip and the second convex strip are fixedly connected to each other perpendicularly, the first through hole is cylindrical and located on the first convex strip, the first through hole is located at an end away from the second convex strip, the first groove is located at an edge of the bottom plate, and the first through hole is movably connected to the first groove through the latch; and the plate body is a cuboid, there are two inserts, the two inserts are both arranged on a same side of the plate body and are symmetrical along an axis, and the axis is a central axis of a side of the plate body; a length of the second convex strip is greater than a height of the through hole, and a side surface of a long side of the second convex strip is connected to a side wall of a long side of the adjacent pallet when a positioning effect of the pallet is achieved; and the pallet includes a second groove, the second groove is located at an edge of a long side of the plate body, the second convex strip is located at an end of the insert away from the plate body, one surface of the second convex strip is parallel to a side surface of the long side of the plate body, a distance between the second groove and the first groove is equal to a length of the first convex strip, the first convex strip rotates around the latch, and the second groove is fitted with the second convex strip when the insert is accommodated; a depth of the second groove is equal to a width of the second convex strip, and the second convex strip is fully embedded in the second groove; and the second groove penetrates the top plate and the bottom plate, and the length of the second convex strip is equal to a thickness of the plate body.

This application further discloses a packaging device, including a pallet, the pallet including: a plate body configured to support stacked cargoes; and a positioning structure configured to reduce a gap between adjacent plate bodies, where the plate body includes a bottom plate, a top plate, a plurality of foot piers, and a plurality of through holes, the bottom plate is located at the bottom of the plate body, the top plate is located at the top of the bottom plate, the bottom plate is arranged parallel to the top plate, the top plate and the bottom plate are fixedly connected through the plurality of foot piers, the plurality of through holes are located between the bottom plate and the top plate, a direction in which the through hole is perforated is perpendicular to a direction of a distance between the top plate and the bottom plate, and the positioning structure is arranged in the through hole.

Optionally, the positioning structure includes an insert movably connected to the through hole.

Optionally, the positioning structure includes a latch, the insert includes a first convex strip, a second convex strip, and a first through hole, and the bottom plate includes a first groove. The first convex strip and the second convex strip are cuboids, the first convex strip and the second convex strip are fixedly connected to each other perpendicularly, the first through hole is cylindrical and located on the first convex strip, the first through hole is located at an end of the first convex strip away from the second convex strip, the first groove is located at an edge of the bottom plate, and the first through hole is movably connected to the first groove through the latch.

Compared with a solution without a positioning structure, this application provides a pallet on which a positioning structure is arranged. The positioning structure can reduce a gap between two adjacent pallets and reduce shaking between the pallets when a truck is moving. The positioning structure is arranged in a through hole, thereby saving space and reducing processing costs without affecting loading and unloading of cargoes.

BRIEF DESCRIPTION OF DRAWINGS

The drawings included are used for providing understanding of embodiments of the present application, constitute part of the specification, and are used for illustrating implementation manners of the present application, and interpreting principles of the present application together with text description. Obviously, the accompanying drawings in the following descriptions are merely some embodiments of this application, and a person of ordinary skill in the art may further obtain other accompanying drawings according to the accompanying drawings without creative efforts. In the accompanying drawings.

DETAILED DESCRIPTION OF EMBODIMENTS

Figure 1:
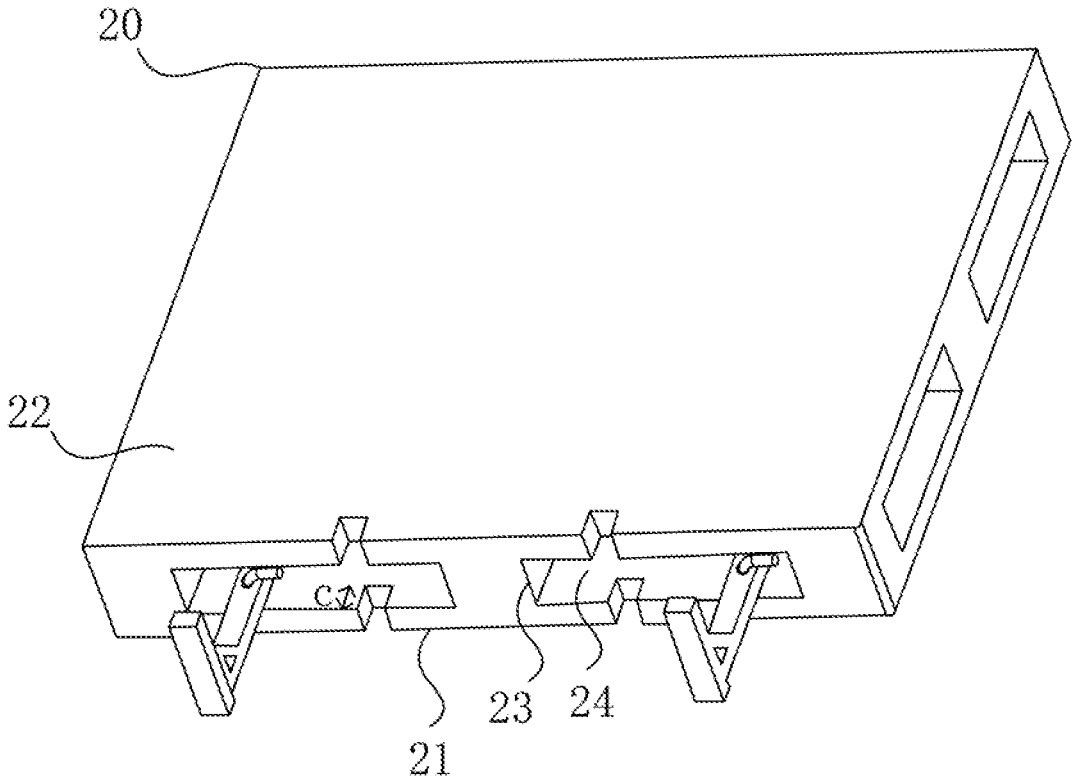
FIG. 1 is a schematic diagram of a pallet with an extended insert according to an embodiment of this application.

Specific structures and functional details disclosed herein are merely representative, and are intended to describe the objectives of exemplary embodiments of this application.

However, this application may be specifically implemented in many alternative forms, and should not be construed as being limited to the embodiments set forth herein.

In the description of this application, it should be understood that orientation or position relationships indicated by the terms such as "center", "transverse", "on", "below", "left", "right", "vertical", "horizontal", "top", "bottom", "inside", and "outside" are based on orientation or position relationships shown in the accompanying drawings, and are used only for ease and brevity of illustration and description, rather than indicating or implying that the mentioned apparatus or component must have a particular orientation or must be constructed and operated in a particular orientation. Therefore, such terms should not be construed as limiting of this application. In addition, the terms "first" and "second" are merely with respect to a purpose of description, and shall not be understood as an indication or implication of relative importance or implicit indication of the number of indicated technical features. Therefore, a feature limited by "first" or "second" may explicitly or implicitly include one or more of the features. In the description of this application, unless otherwise stated, "a plurality of" means two or more than two. In addition, the terms "include", "comprise" and any variant thereof are intended to cover non-exclusive inclusion.

In the description of this application, it should be noted that unless otherwise explicitly specified or defined, the terms such as "mount", "install", "connect", and "connection" should be understood in a broad sense. For example, the connection may be a fixed connection, a detachable connection, or an integral connection; or the connection may be a mechanical connection or an electrical connection; or the connection may be a direct connection, an indirect connection through an intermediary, or internal communication between two components. Persons of ordinary skill in the art may understand the specific meanings of the foregoing terms in this application according to specific situations.

The terminology used herein is for the purpose of describing specific embodiments only and is not intended to be limiting of exemplary embodiments. As used herein, the singular forms "a", "an" and "the" are intended to include the plural forms as well, unless the context clearly indicates otherwise. It should be further understood that the terms "include" and/or "comprise" when used in this specification, specify the presence of stated features, integers, steps, operations, elements, and/or components, but do not preclude the presence or addition of one or more other features, integers, steps, operations, elements, components, and/or combinations thereof.

The applicant adopts two undisclosed methods to secure cargoes. One is to wrap and bundle the cargoes with packing tape, and the other is to use cushioning materials to fill a gap.

The first securing method is time-consuming and laborious. Because a length of a container exceeds 12 meters, the cargoes are placed too much, the packing tape lacks a fixed point during bundling, and winding is prone to loosening, the securing is not firm. In the second securing method, there is still a large gap in some locations, there is a lot of garbage during unloading and transhipment while a lot of costs are wasted due to adding of buffer materials, and environmental pollution is caused because some cushion foams cannot be degraded in a short time.

This application is further described below with reference to the accompanying drawings and optional embodiments.

As shown in FIG. 1 to FIG. 6, an embodiment of this application discloses a pallet 10, including:

a plate body 20 configured to support stacked cargoes; and a positioning structure 30 configured to reduce a gap between adjacent plate bodies 20, where the plate body 20 includes a bottom plate 21, a top plate 22, a plurality of foot piers 23, and a plurality of through holes 24. The bottom plate 21 is located at the bottom of the plate body 20, the top plate 22 is located at the top of the bottom plate 21, the bottom plate 21 is arranged parallel to the top plate 22, the top plate 22 and the bottom plate 21 are fixedly connected through the plurality of foot piers 23, the plurality of through holes 24 are located between the bottom plate 21 and the top plate 22, a direction in which the through hole 24 is perforated is perpendicular to a direction of a distance between the top plate 22 and the bottom plate 21, and the positioning structure 30 is arranged in the through hole 24.

In an embodiment, the positioning structure 30 includes an insert 31 movably connected to the through hole 24.

In this solution, the insert 31 is movably connected to the through hole 24, and can be taken out when the pallet is positioned and accommodated without the positioning, thereby saving space of the pallet 10 and facilitating positioning and loading and unloading of cargoes.

In an embodiment, the positioning structure 30 includes a latch 32, the insert 31 includes a first convex strip 33, a second convex strip 34, and a first through hole 35, and the bottom plate 21 includes a first groove 25. The first convex strip 33 and the second convex strip 34 are cuboids, the first convex strip 33 and the second convex strip 34 are fixedly connected to each other perpendicularly, the first through hole 35 is cylindrical and located on the first convex strip 33, the first through hole 35 is located at an end away from the second convex strip 34, the first groove 25 is located at an edge of the bottom plate 21, and the first through hole 35 is movably connected to the first groove 25 through the latch 32.

In this solution, the latch 32 is selected as a fixed point for a movable connection of the insert 31, the structure is simple and convenient, and the insert 31 is rotated by using the first groove 25 and the first through hole 35 as a rotation point. The first groove 25 is arranged at the edge of the bottom plate 21 to facilitate mounting of the insert 31 and reduce obstruction of the top plate 22 and bottom plate 21 to the mounting of the insert 31. Because a side wall of the plate body 20 is a flat surface, a side surface of the second convex strip 34 also needs to be a flat surface to ensure that the plate body and the second convex strip fit tighter and ensure a positioning effect of the pallet 10, and the first convex strip 33 needs to be parallel to the bottom plate 21 to ensure stability of the movable connection of the insert 31, so that the second convex strip 34 and the first convex strip 33 are fixedly connected to each other perpendicularly to ensure that the second convex strip 34 is parallel to a side wall of the pallet 10 when the insert 31 is rotated, thereby increasing a contact area between the second convex strip 34 and the side wall of the pallet 10 and improving stability of mutual positioning between the pallets 10.

In an embodiment, a material of the latch 32 is metal.

In this solution, in actual production and transportation, most of used pallets 10 are made of wooden materials, and the latch 32 is made of a metal material correspondingly. Most metal materials have higher hardness than wooden materials, and have a long service life and are easy to replace. Those skilled in the art choose ferrous metal as the material of the latch 32 because iron satisfies the hardness and is relatively cheap and easy to process.

In an embodiment, a shape of each of the first through hole 35, the first groove 25, and the latch 32 is a cylinder.

In this solution, the insert 31 is fixed on the first groove 25 through the latch 32, and the insert 31 is accommodated in the plate body when the insert is not in use. In this case, the insert 31 is rotatably accommodated by using the latch 32 as a center. During rotation of the insert 31, the insert inevitably rubs against the latch 32, and a surface of a circular body is the same as a trajectory of the rotation of the insert 31, so that the insert 31 can be smoothly transitioned during the rotation, and damage to the insert 31 can be reduced without much operator's effort during use.

In an embodiment, a diameter of the first groove 25 is equal to a diameter of the latch 32.

In this solution, the first groove 25 is fitted with the latch 32 to fix the latch 32. The diameter of the latch 32 is equal to the diameter of the first groove 25. The latch and the first groove fit tightly to achieve fixation, and the latch 32 does not damage the first groove 25. In addition, a force applied to the latch 32 during use mainly comes from the rotation of the insert 31 when the insert is accommodated. A direction of a force when the insert 31 rotates is perpendicular to a fixing direction of the latch 32, so that stability of the fixing of the latch 32 can be ensured.

In an embodiment, a diameter of the first through hole 35 is greater than a diameter of each of the first groove 25 and the latch 32.

In this solution, the insert 31 rotates on the latch 32 through the first through hole 35. The diameter of the first through hole 35 is greater than the diameter of each of the first groove 25 and the latch 32, thereby reducing resistance of the insert 31 during the rotation and facilitating the accommodation of the insert 31.

In an embodiment, a diameter of the first groove 25 is less than a diameter of the latch 32.

In this solution, the latch 32 can be fixed to the first groove 25 through interference fit, so that the latch 32 is fixed more stably and is not easy to fall off.

In an embodiment, the latch 32 includes a first latch 37 and a second latch 38. The first latch 37 is perpendicularly connected to the second latch 38, and the second latch 38 is movably connected to the first groove 25.

In this solution, the first latch 37 is perpendicularly connected to the second latch 38, and the first latch 37 prevents the second latch 38 from fully entering the first groove 25, resulting in failure to remove. The first latch 37 can also better fit the plate body, reducing space occupied by the first latch 37.

Referring to FIG. 1, FIG. 3, FIG. 4, FIG. 6, and FIG. 7, an alternative to the latch 32 is disclosed. The positioning structure 30 includes a nail 26, the insert 31 includes a first convex strip 33, a second convex strip 34, and a first through hole 35, and the bottom plate 21 includes a first groove 25. The first convex strip 33 and the second convex strip 34 are cuboids, the first convex strip 33 and the second convex strip 34 are fixedly connected to each other perpendicularly, the first through hole 35 is cylindrical and located on the first convex strip 33, the first through hole 35 is located at an end away from the second convex strip 34, the first groove 25 is located at an edge of the bottom plate 21, and the first through hole 35 is movably connected to the first groove 25 through the nail 26.

In this solution, in the alternative to the latch 32, the nail 26 can also have the effect of connecting and fixing, and most nail 26 is made of metal materials, so that connection strength can be met.

In an embodiment, a shape of the plate body 20 is a cuboid, and there are two inserts 31. The two inserts 31 are both arranged on a same side of the plate body 20 and are symmetrical along an axis, and the axis is a central axis of a side of the plate body 20.

In this solution, if only one insert 31 is used for each pallet 10 and fixed in the middle of a side wall of a long side of the pallet 10, although the pallet 10 can be prevented from moving left to right when a truck is driving straight and bumpy, when the truck turns sharply, front and rear sides of the pallet 10 are shifted by a force, and the pallet 10 is shifted back and forth, resulting in unstable loading of the pallet 10. Therefore, there are two inserts 31, and the two inserts 31 are both located on a side wall of any long side of the pallet 10 and are symmetrical along the axis. In this way, it can be ensured that there are inserts 31 on the front and rear sides of the long side of the pallet 10 as supporting points, and forces applied to the front and rear sides are uniform, thereby improving the positioning effect of the pallet 10 and coping with a situation of an inverted pallet of the truck in various driving states.

In an embodiment, a length b of the second convex strip is greater than a height of the through hole 24, and the length of the second convex strip 34 is greater than a spacing between a bottom surface of the top plate 22 and a top surface of the bottom plate 21 when a positioning effect of the pallet 10 is achieved.

In this solution, in order to achieve the positioning effect, the second convex strip 34 needs to be pressed against the side wall of the long side of the adjacent pallet 10, and there is the through hole 24 on the side wall of the long side of the pallet 10 and the through hole 24 do not support the second convex strip 34. Therefore, the length b of the second convex strip is greater than the spacing between the bottom surface of the top plate 22 and the top surface of the bottom plate 21, to ensure that the side wall of the long side of the pallet 10 is attached to a side surface of a long side of the second convex strip 34, thereby achieving the positioning effect of the insert 31.

In an embodiment, the pallet 10 includes a second groove 40. The second groove 40 is located at an edge of a long side of the pallet 10, the second convex strip 34 is located at an end of the insert 31 away from the plate body 20, one surface of the second convex strip 34 is parallel to a side surface of a long side of the plate body 20, a distance between the second groove 40 and the first groove 25 is equal to a length of the first convex strip 33, the first convex strip 33 rotates around the latch 32, and the second groove 40 is fitted with the second convex strip 34 when the insert 31 is accommodated.

In this solution, the length b of the second convex strip 34 is greater than the height of the through hole 24, and the second convex strip 34 rotates around the first groove 25 as a center point through the first convex strip 33. In this case, the second convex strip 34 cannot be accommodated in the through hole 24 and space of the pallet 10 is occupied. Therefore, the second groove 40 is arranged on the edge of the long side of the pallet 10 so that the distance between the second groove 40 and the first groove 25 is equal to the length of the first convex strip 33. In this way, the second convex strip 34 can be accommodated in the second groove 40 and the first convex strip 33 can be accommodated in the through hole 24 during the rotation of the insert 31, thereby implementing the accommodation of the insert 31 and saving space occupied by the insert 31.

In an embodiment, the second groove 40 penetrates the plate body 20, and a length b of the second convex strip 34 is equal to a thickness of the plate body 20.

In this solution, the second groove 40 directly penetrates the plate body 20, and the length b of the second convex strip 34 is equal to the thickness of the plate body 20, thereby maximizing a contact area between the second convex strip 34 and another plate body 20, so that a connection of the pallet 10 is more stable.

In an embodiment, a width of the second groove 40 is greater than a height d of the second convex strip 34, and the second convex strip 34 does not touch an outer wall of the second groove 40 during rotation.

In this solution, because the second convex strip 34 is accommodated in the second groove 40 through the rotation of the first convex strip 33, a path during entering of the second convex strip 34 into the second groove 40 through the rotation is arc-shaped. If the width of the second groove 40 is equal to the height of the second convex strip 34, it is difficult for the second convex strip 34 to enter the second groove 40 through the rotation. Therefore, the width of the second groove 40 is greater than the height of the second convex strip 34, so that there is enough space in the second groove 40 to facilitate the rotation for the accommodation of the second convex strip 34 in the second groove 40.

In an embodiment, a depth c of the second groove is equal to a width a of the second convex strip, and the second convex strip 34 is fully embedded in the second groove 40.

Because the second convex strip 34 is accommodated in the second groove 40 through the rotation of the first convex strip 33, and the depth c of the second groove is equal to the width a of the second convex strip, the second convex strip 34 cannot protrude from the side wall of the long side of the pallet 10 after being accommodated, and the side wall of the long side of the pallet 10 remains flat. In this way, when the insert 31 is being accommodated, the second convex strip 34 does not occupy space to avoid hindering loading and unloading of cargoes.

In an embodiment, the second groove 40 penetrates the top plate 22 and the bottom plate 21, and a length b of the second convex strip is equal to a thickness of the plate body 20.

The insert 31 is pressed against the side wall of the long side of the pallet 10 through the side wall of the long side of the second convex strip 34 to implement positioning of the pallet 10. If a truck equipped with the pallet 10 shakes, a force is generated between the side wall of the long side of the pallet 10 and the second convex strip 34. In order to reduce pressure generated by the force, the length of the second convex strip needs to be increased to increase a contact area between the second convex strip and the side wall of the long side of the pallet 10, thereby ensuring structure stability of the insert 31 and improving the positioning effect. However, the length b of the second convex strip cannot exceed the thickness of the plate body 20. If the length of the second convex strip exceeds the thickness of the plate body, the length b of the second convex strip exceeds that of the top plate 22 or the bottom plate 21. In this case, loading of cargoes is affected or the bottom plate 21 cannot be placed flat, thereby affecting stability of loading cargoes by the pallet 10.

In an embodiment, the insert 31 includes a reinforcing structure 36. A shape of the reinforcing structure 36 is an elongated body, one end of the reinforcing structure 36 is fixedly connected to a side wall of the first convex strip 33, and the other end of the reinforcing structure 36 is fixedly connected to a side wall of the second convex strip 34.

Most of forces on positioning of each pallet 10 are concentrated on the second convex strip 34. In order to reduce costs and reduce a weight and a volume of the insert 31, a contact area of a location of a fixed connection between the second convex strip 34 and the first convex strip 33 should not be too large. Therefore, strength at this location is not enough. In order to prevent the connection between the second convex strip 34 and the first convex strip 33 from breaking or deforming, the reinforcing structure 36 is arranged at this location, so that one end of the reinforcing structure 36 is fixedly connected to the side wall of the first convex strip, and the other end is fixedly connected to the side wall of the second convex strip 34. Therefore, the reinforcing structure 36 can bear a part of the force when the second convex strip 34 is positioned and subjected to force, thereby preventing the connection between the second convex strip 34 and the first convex strip 33 from being broken or deformed, and improving structural strength of the insert 31.

In another embodiment of this application, referring to FIG. 1 to FIG. 6, a pallet 10 is disclosed, including: a plate body 20 configured to support stacked cargoes; and a positioning structure 30 configured to reduce a gap between adjacent plate bodies 20.

The plate body 20 includes a bottom plate 21, a top plate 22, a plurality of foot piers 23, and a plurality of through holes 24. The bottom plate 21 is located at the bottom of the plate body 20, the top plate 22 is located at the top of the bottom plate 21, the bottom plate 21 is arranged parallel to the top plate 22, the top plate 22 and the bottom plate 21 are fixedly connected through the plurality of foot piers 23, the plurality of through holes 24 are located between the bottom plate 21 and the top plate 22, a direction in which the through hole 24 is perforated is perpendicular to a direction of a distance between the top plate 22 and the bottom plate 21, and the positioning structure 30 is arranged in the through hole 24.

The positioning structure 30 includes an insert 31 and a latch 32. The insert 31 is movably connected to the through hole 24, the insert 31 includes a first convex strip 33, a second convex strip 34, and a first through hole 35, and the bottom plate 21 includes a first groove 25. The first convex strip 33 and the second convex strip 34 are cuboids, the first convex strip 33 and the second convex strip 34 are fixedly connected to each other perpendicularly, the first through hole 35 is cylindrical and located on the first convex strip 33, the first through hole 35 is located at an end away from the second convex strip 34, the first groove is 25 located at an edge of the bottom plate 21, and the first through hole 35 is movably connected to the first groove 25 through the latch 32.

A shape of the plate body 20 is a cuboid, and there are two inserts 31. The two inserts 31 are both arranged on a side wall of any long side of the plate body 20 and are symmetrical along an axis.

A length b of the second convex strip is greater than a height of the through hole 24, and a side surface of a long side of the second convex strip 34 is connected to a side wall of a long side of the adjacent pallet 10 when a positioning effect of the pallet 10 is achieved.

The pallet 10 includes a second groove 40. The second groove 40 is located at an edge of a long side of the pallet 10, the second convex strip 34 is located at an end of the insert 31 away from the plate body 20, one surface of the second convex strip 34 is parallel to a side surface of a long side of the plate body 20, a distance between the second groove 40 and the first groove 25 is equal to a length of the first convex strip 33, and the second groove 40 is fitted with the second convex strip 34 when the insert 31 is accommodated.

A depth c of the second groove is equal to a width a of the second convex strip, and the second convex strip 34 is fully embedded in the second groove 40.

The second groove 40 penetrates the top plate 22 and the bottom plate 21, and a length b of the second convex strip is equal to a thickness of the plate body 20.

The insert 31 includes a reinforcing structure 36, a shape of the reinforcing structure 36 is an elongated body, one end of the reinforcing structure 36 is fixedly connected to a side wall of the first convex strip 33, and the other end of the reinforcing structure 36 is fixedly connected to a side wall of the second convex strip 34.

The through hole 24 is in the middle of the top plate 22 and the bottom plate 21, so that the through hole can be used by a forklift to pick up, and can also provide a movable connection position for the insert 31 and also provide space for the insert 31 to be accommodated in the pallet 10. Therefore, no additional processing of the through hole 24 is required, thereby saving space and reducing processing costs of the pallet 10. the insert 31 is movably connected to the through hole 24, and can be taken out during positioning and accommodated without positioning, thereby saving space of the pallet 10 and facilitating positioning and loading and unloading of cargoes.

The latch 32 is selected as a fixed point for a movable connection of the insert 31, the structure is simple and convenient, and the insert 31 is rotated by using the first groove 25 and the first through hole 35 as a rotation point. The first groove 25 is arranged at the edge of the bottom plate 21 to facilitate mounting of the insert 31 and reduce obstruction of the top plate 22 and bottom plate 21 to the mounting of the insert 31. Because a side wall of the pallet 10 is a flat surface, a side surface of the second convex strip 34 also needs to be a flat surface to ensure that the plate body and the second convex strip fit tighter and ensure a positioning effect of the pallet 10, and the first convex strip 33 needs to be parallel to the bottom plate 21 to ensure stability of the movable connection of the insert 31, so that the second convex strip 34 and the first convex strip 33 are fixedly connected to each other perpendicularly to ensure that the second convex strip 34 is parallel to a side wall of the pallet 10 when the insert 31 is rotated, thereby increasing a contact area between the second convex strip 34 and the side wall of the pallet 10 and improving stability of mutual positioning between the pallets 10.

If only one insert 31 is used for each pallet 10 and fixed in the middle of a side wall of a long side of the pallet 10, although the pallet 10 can be prevented from moving left to right when a truck is driving straight and bumpy, when the truck turns sharply, front and rear sides of the pallet 10 are shifted by a force, and the pallet 10 is shifted back and forth, resulting in unstable loading of the pallet 10. Therefore, there are two inserts 31, and the two inserts 31 are both located on a side wall of any long side of the pallet 10 and are symmetrical along the axis. In this way, it can be ensured that there are inserts 31 on the front and rear sides of the long side of the pallet 10 as supporting points, and a force applied to the front and rear sides is uniform, thereby improving the positioning effect of the pallet 10 and coping with a situation of an inverted pallet of the truck in various driving states.

In order to achieve the positioning effect, the second convex strip 34 needs to be pressed against the side wall of the long side of the adjacent pallet 10, and there is the through hole 24 on the side wall of the long side of the pallet 10 and the through hole 24 do not support the second convex strip 34. Therefore, a height of the second convex strip 34 needs to be greater than the height of the through hole 24, to ensure that the side wall of the long side of the pallet 10 is attached to a side surface of a long side of the second convex strip 34, thereby achieving the positioning effect of the insert 31.

The length b of the second convex strip is greater than the height of the through hole 24, and the second convex strip 34 rotates around the first groove 25 as a center point through the first convex strip 33. In this case, the second convex strip 34 cannot be accommodated in the through hole 24 and space of the pallet 10 is occupied. Therefore, the second groove 40 is arranged on the edge of the long side of the pallet 10 so that the distance between the second groove 40 and the first groove 25 is equal to the length of the first convex strip 33. In this way, the second convex strip 34 can be accommodated in the second groove 40 and the first convex strip 33 can be accommodated in the through hole 24 during the rotation of the insert 31, thereby implementing the accommodation of the insert 31 and saving space occupied by the insert 31.

Because the second convex strip 34 is accommodated in the second groove 40 through the rotation of the first convex strip 33, a path during entering of the second convex strip 34 into the second groove 40 through the rotation is arc-shaped. If the width of the second groove 40 is equal to the height of the second convex strip 34, it is difficult for the second convex strip 34 to enter the second groove 40 through the rotation. Therefore, the width of the second groove 40 is greater than the height of the second convex strip 34, so that there is enough space in the second groove 40 to facilitate the rotation for the accommodation of the second convex strip 34 in the second groove 40.

Because the second convex strip 34 is accommodated in the second groove 40 through the rotation of the first convex strip 33, and the depth c of the second groove is equal to the width a of the second convex strip, the second convex strip 34 cannot protrude from the side wall of the long side of the pallet 10 after being accommodated, and the side wall of the long side of the pallet 10 remains flat. In this way, when the insert 31 is being accommodated, the second convex strip 34 does not occupy space to avoid hindering loading and unloading of cargoes.

The insert 31 is pressed against the side wall of the long side of the pallet 10 through the side wall of the long side of the second convex strip 34 to implement positioning of the pallet 10. If a truck equipped with the pallet 10 shakes, a force is generated between the side wall of the long side of the pallet 10 and the second convex strip 34. In order to reduce pressure generated by the force, the length of the second-convex strip needs to be increased to increase a contact area between the second convex strip and the side wall of the long side of the pallet 10, thereby ensuring structure stability of the insert 31 and improving the positioning effect. However, the length b of the second convex strip cannot exceed the thickness of the plate body 20. If the length of the second convex strip exceeds the thickness of the plate body, the length b of the second convex strip exceeds that of the top plate 22 or the bottom plate 21. In this case, loading of cargoes is affected or the bottom plate 21 cannot be placed flat, thereby affecting stability of loading cargoes by the pallet 10.

Most of forces on positioning of each pallet 10 are concentrated on the second convex strip 34. In order to reduce costs and reduce a weight and a volume of the insert 31, a contact area of a location of a fixed connection between the second convex strip 34 and the first convex strip 33 should not be too large. Therefore, strength at this location is not enough. In order to prevent the connection between the second convex strip 34 and the first convex strip 33 from breaking or deforming, the reinforcing structure 36 is arranged at this location, so that one end of the reinforcing structure 36 is fixedly connected to the side wall of the first convex strip, and the other end is fixedly connected to the side wall of the second convex strip 34. Therefore, the reinforcing structure 36 can bear a part of the force when the second convex strip 34 is positioned and subjected to force, thereby preventing the connection between the second convex strip 34 and the first convex strip 33 from being broken or deformed, and improving structural strength of the insert 31.

Figure 2:
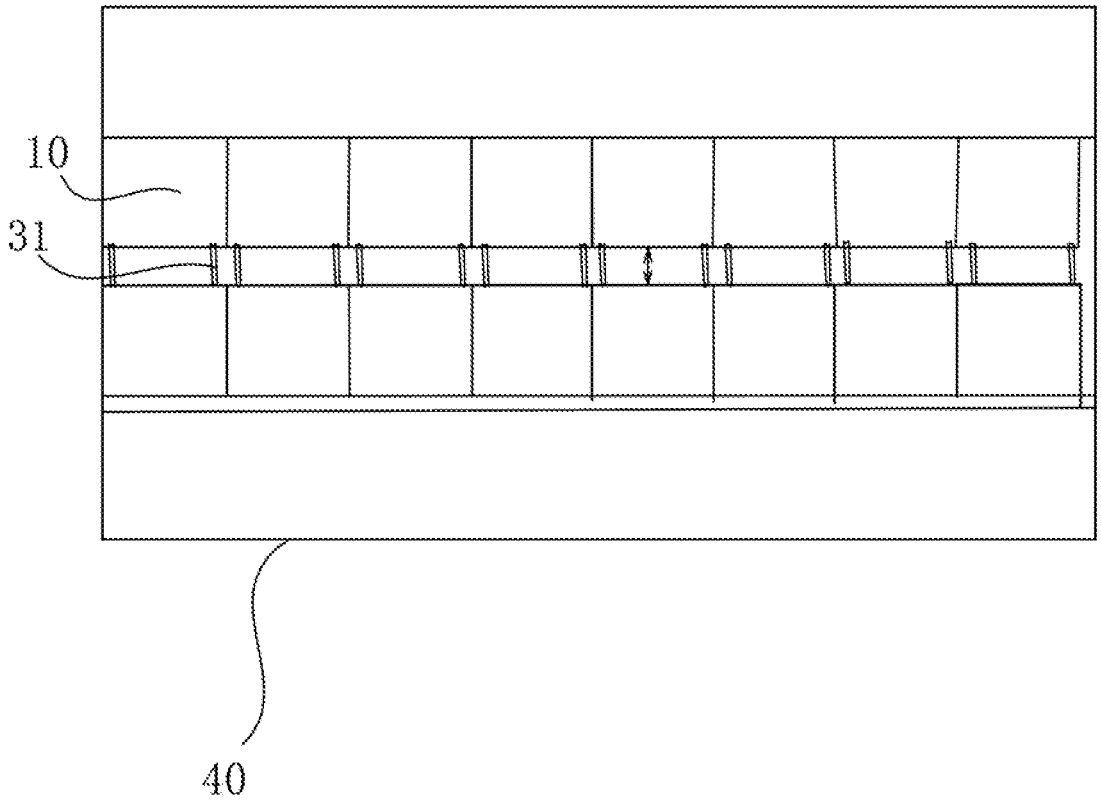
FIG. 2 is a schematic top view of a plurality of stacked pallets according to an embodiment of this application.
Figure 3:
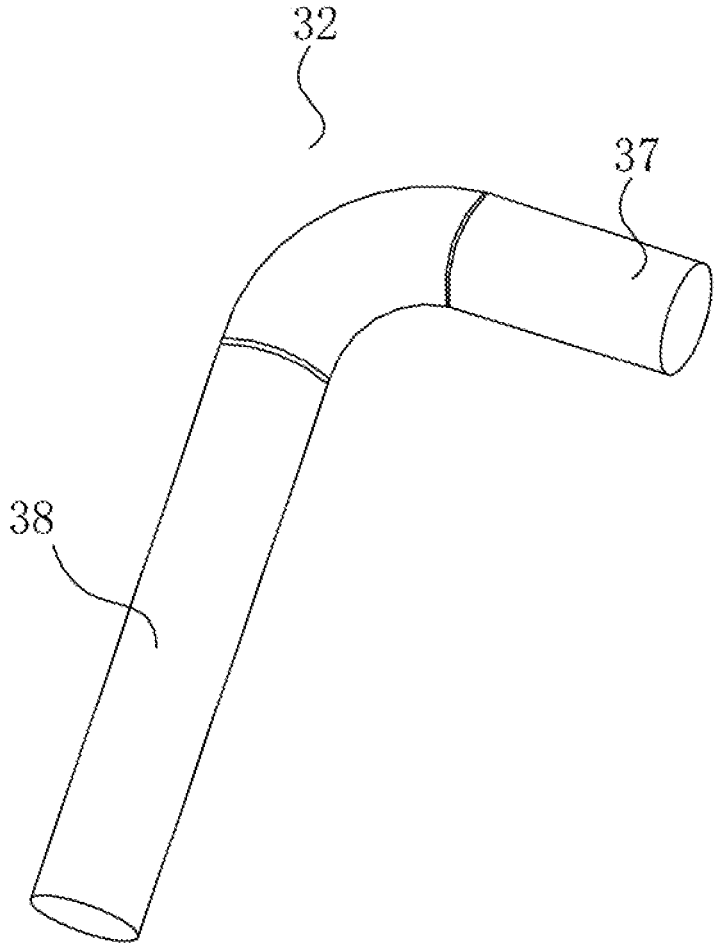
FIG. 3 is a schematic diagram of a latch according to an embodiment of this application.
Figure 4:
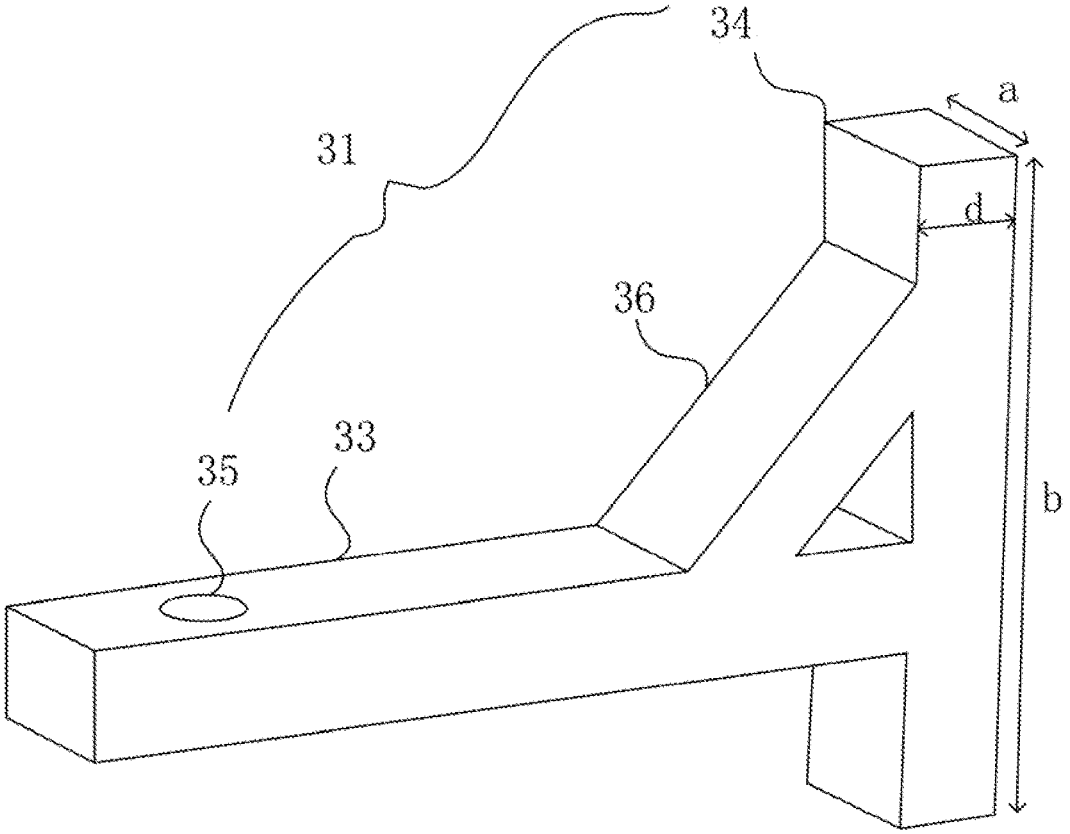
FIG. 4 is a schematic diagram of an insert according to an embodiment of this application.
Figure 5:
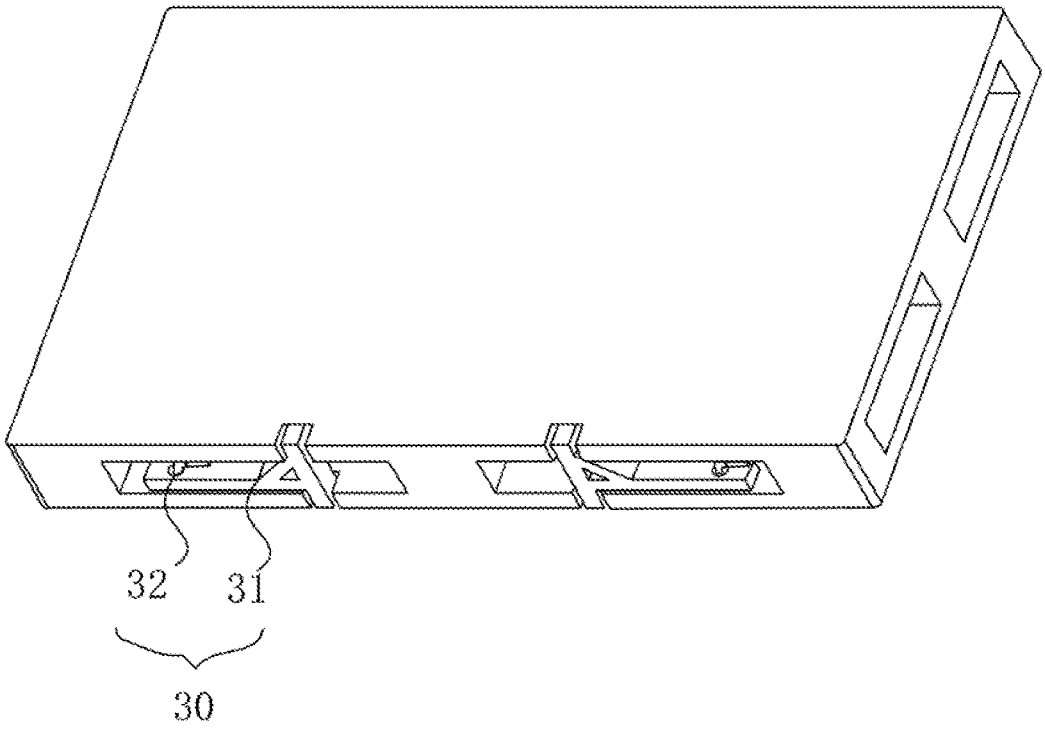
FIG. 5 is a schematic diagram of an insert after accommodation according to an embodiment of this application.
Figure 6:
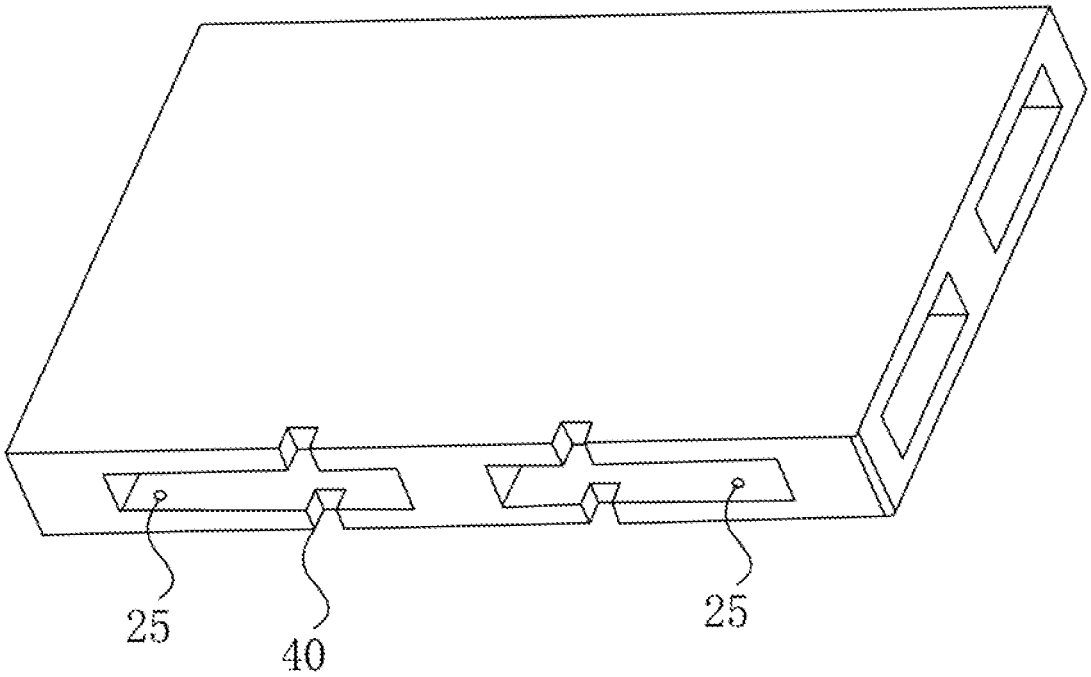
FIG. 6 is a schematic diagram of an insert after disassembling according to an embodiment of this application.
Figure 7:
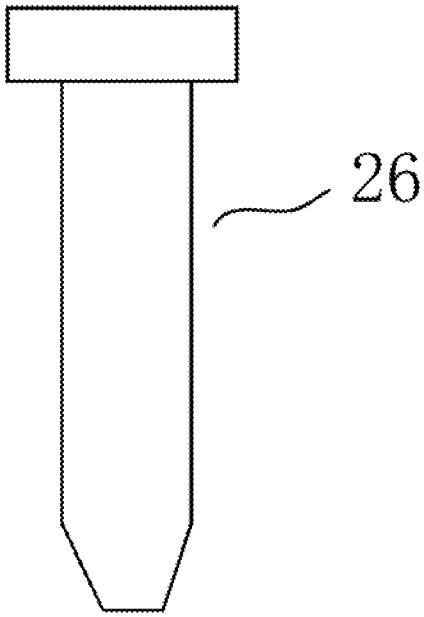
FIG. 7 is a schematic diagram of a nail according to an embodiment of this application.

In another embodiment of this application, referring to FIG. 2, a packaging device 40 is provided, including the pallet 10 in any of the above embodiments.

The foregoing contents are detailed descriptions of this application in conjunction with specific optional embodiments, and it should not be considered that the specific implementation of this application is limited to these descriptions. Persons of ordinary skill in the art can further make simple deductions or replacements without departing from the concept of this application, and such deductions or replacements should all be considered as falling within the protection scope of this application.

What is claimed is:

1. A pallet, comprising:

a plate body configured to support stacked cargoes; and a positioning structure configured to reduce a gap between adjacent plate bodies, wherein the plate body comprises a bottom plate, a top plate, a plurality of foot piers, and a plurality of main slots, wherein the bottom plate is disposed at a bottom of the plate body, the top plate is disposed over the bottom plate, wherein the bottom plate is arranged parallel to the top plate, wherein the top plate and the bottom plate are fixedly connected together through the plurality of foot piers, wherein the plurality of main slots are located between the bottom plate and the top plate and are blind on the side of the bottom plate and on the side of the top plate, wherein one end of the positioning structure is arranged in a respective main slot, another end of the positioning structure is operative extend outside of the respective main slot and is operative to extend out of a corresponding edge of the bottom plate and a corresponding edge of the top plate;

wherein the plurality of main slots are each defined by two adjacent foot piers spaced apart from each other, together with corresponding portions of the top and bottom plates, wherein the plurality of main slots each comprise an opening perpendicular to the top and bottom plates;

wherein the one end of the positioning structure is rotatably connected to the plate body, and the other end of the positioning structure is operative to rotate into the respective main slot;

wherein the positioning structure comprises an insert and a latch, wherein the insert comprises a first convex bar, a second convex bar fixedly and perpendicularly connected to the first convex bar, and a cylindrical first through hole defined in an end of the first convex bar far away from the second convex bar, wherein the first convex bar and the second convex bar are both cuboids; wherein the bottom plate comprises a first slot defined in a corresponding portion of the bottom plate surrounding each main slot and at an edge of the bottom plate adjacent to the opening of the corresponding main slot, wherein the latch is inserted through the first through hole into the first slot thus rotatably connecting the insert with the corresponding portion of the bottom plate.

2. The pallet according to claim 1, wherein the latch is made of metal.

3. The pallet according to claim 1, wherein the first slot and the latch are each cylindrical shaped.

4. The pallet according to claim 3, wherein the first through hole has a greater diameter than a diameter of the latch.

5. The pallet according to claim 3, wherein the first slot has a diameter equal to a diameter of the latch.

6. The pallet according to claim 3, wherein the first slot has a diameter less than a diameter of the latch.

7. The pallet according to claim 1, wherein the latch comprises a first latch portion and a second latch portion, wherein the first latch portion is perpendicularly connected to the second latch portion, and wherein the first latch portion is movably inserted into the first slot.

8. The pallet according to claim 1, wherein the insert comprises a reinforcing structure, which is an elongated body, wherein one end of the reinforcing structure is fixedly connected to a side wall of the first convex bar, and wherein another end of the reinforcing structure is fixedly connected to a side wall of the second convex bar.

9. The pallet according to claim 1, wherein the plate body is a cuboid, and there are two inserts, both arranged on a same rectangular side of the plate body and are symmetrical along a central vertical axis of the rectangular side of the plate body.

10. The pallet according to claim 1, wherein a length of the second convex bar is greater than a spacing between a bottom surface of the top plate and a top surface of the bottom plate.

11. The pallet according to claim 1, wherein the plate body is a cuboid, and the pallet comprises a second groove defined at an edge of a long side of the plate body, wherein the second groove comprises a top notch defined in an edge of a portion of the top plate corresponding to each main slot, and a bottom notch defined in an edge of a portion of the bottom plate corresponding to the main slot, wherein the second convex bar is located at an end of the insert opposite the end of insert rotatably connected to the bottom plate, wherein one surface of the second convex bar is parallel to a side surface of the long side of the plate body, a distance between the second groove and the first slot is equal to a length of the first convex bar, wherein the first convex bar is rotatable around the latch, and the second convex bar is fitted in the second groove when the insert is retracted back into the respective main slot.

12. The pallet according to claim 11, wherein the second groove penetrates the plate body along a thickness of the plate body, and wherein a length of the second convex bar is equal to a thickness of the plate body.

13. The pallet according to claim 11, wherein a depth of the second groove measured along a width of the plate body is equal to a width of the second convex bar, and wherein the second convex bar is operative to be fully embedded within the second groove.

14. A pallet, comprising:

a plate body configured to support stacked cargoes; and a positioning structure configured to reduce a gap between adjacent plate bodies, wherein the plate body comprises a bottom plate, a top plate, a plurality of foot piers, and a plurality of main slots, wherein the bottom plate is disposed at a bottom of the plate body, the top plate is disposed over the bottom plate, wherein the bottom plate is arranged parallel to the top plate, wherein the top plate and the bottom plate are fixedly connected together through the plurality of foot piers, wherein the plurality of main slots are located between the bottom plate and the top plate and are blind on the side of the bottom plate and on the side of the top plate, wherein one end of the positioning structure is arranged in a respective main slot, another end of the positioning structure is operative to extend outside of the respective main slot and is operative to extend out of a corresponding edge of the bottom plate and a corresponding edge of the top plate; wherein the plurality of main slots are each defined by two adjacent foot piers spaced apart from each other, together with corresponding portions of the top and bottom plates, wherein the plurality of main slots each comprise an opening perpendicular to the top and bottom plates;

wherein the positioning structure comprises an insert and a latch, wherein the insert comprises a first convex bar, a second convex bar fixedly and perpendicularly connected to the first convex bar, and a cylindrical first through hole defined in an end of the first convex bar far away from the second convex bar, wherein the first convex bar and the second convex bar are both cuboids; wherein the bottom plate comprises a first slot defined in a corresponding portion of the bottom plate surrounding each main slot and at an edge of the bottom plate adjacent to the opening of the corresponding main slot, wherein the latch is inserted through the first through hole into the first slot thus rotatably connecting the insert with the corresponding portion of the bottom plate;

wherein the plate body is a cuboid, and there are two inserts, both arranged on a same rectangular side of the plate body and are symmetrical along central vertical axis of the rectangular side of the plate body; wherein a length of the second convex bar is greater than a height of the respective main slot, and wherein a side surface of a long side of the second convex bar abuts against a side wall of a long side of an adjacent pallet when the pallet is being secured with respect to the adjacent pallet; and the pallet comprises a second groove defined at an edge of a long side of the plate body, wherein the second groove comprises a top notch defined in an edge of a portion of the top plate corresponding to each main slot, and a bottom notch defined in an edge of a portion of the bottom plate corresponding to the main slot, wherein the second convex bar is located at an end of the insert opposite the end of the insert rotatably connected to the bottom plate, wherein one surface of the second convex bar is parallel to a side surface of the long side of the plate body, a distance between the second groove and the first slot is equal to a length of the first convex bar, the first convex bar is rotatable around the latch, and the second convex bar is fitted in the second groove when the insert is retracted back into the respective main slot; and a depth of the second groove measured along a width of the plate body is equal to a width of the second convex bar, and wherein the second convex bar is operative to be fully embedded in the second groove; and wherein the second groove penetrates the top plate and the bottom plate, and a length of the second convex bar is equal to a thickness of the plate body.

15. A packaging device, comprising the pallet according to claim 1.

16. A pallet, comprising:

a plate body configured to support stacked cargoes; and a positioning structure configured to reduce a gap between adjacent plate bodies, wherein the plate body comprises a bottom plate, a top plate, a plurality of foot piers, and a plurality of main slots, wherein the bottom plate is located at a bottom of the plate body, the top plate is located over the bottom plate, wherein the bottom plate is arranged parallel to the top plate, wherein the top plate and the bottom plate are fixedly connected together through the plurality of foot piers, wherein the plurality of main slots are located between the bottom plate and the top plate and are blind on the side of the bottom plate and on the side of the top plate, wherein one end of the positioning structure is arranged in a respective main slot, another end of the positioning structure is operative extend outside of the respective main slot and is operative to extend out of an edge of the bottom plate and an edge of the top plate;

wherein the plurality of main slots are each defined by two adjacent foot piers spaced apart from each other, together with corresponding portions of the top and bottom plates, wherein the plurality of main slots each comprise an opening perpendicular to the top and bottom plates;

wherein the one end of the positioning structure is rotatably connected to the plate body, and the other end of the positioning structure is operative to rotate into the respective main slot;

wherein the positioning structure comprises an insert and a nail, wherein the insert comprises a first convex bar, a second convex bar fixedly and perpendicularly connected to the first convex bar, and a cylindrical first through hole defined in an end of the first convex bar far away from the second convex bar, wherein the first convex bar and the second convex bar are both cuboids; wherein the bottom plate comprises a first slot defined in a corresponding portion of the bottom plate surrounding each main slot and at an edge of the bottom plate adjacent to the opening of the corresponding main slot, wherein the nail is inserted through the first through hole into the first slot thus rotatably connecting the insert with the corresponding portion of the bottom plate.

* * * * *